US006851661B1

(12) United States Patent
Penning

(10) Patent No.: US 6,851,661 B1
(45) Date of Patent: Feb. 8, 2005

(54) MULTI-PURPOSE PORTABLE LAY-DOWN FENCE

(76) Inventor: Dennis E. Penning, 8427 Bridle Spur, St. Louis, MO (US) 63042

( * ) Notice: Subject to any disclaimer, the term of this patent is extended or adjusted under 35 U.S.C. 154(b) by 13 days.

(21) Appl. No.: 10/629,980

(22) Filed: Jul. 30, 2003

(51) Int. Cl.[7] ..... A63F 9/00
(52) U.S. Cl. ..... 256/59; 256/65.01; 256/19
(58) Field of Search ..... 256/59, 65.01, 256/19, 24, 25, 26, 1, 47, 67, 65.14; 404/10

(56) References Cited

U.S. PATENT DOCUMENTS

| | | | | |
|---|---|---|---|---|
| 1,857,435 A | * | 5/1932 | Cole | 256/13.1 |
| 1,877,074 A | * | 9/1932 | Stanziale | 256/13.1 X |
| 2,949,324 A | * | 8/1960 | Birge et al. | 256/13.1 X |
| 4,106,879 A | * | 8/1978 | Diedershagen et al. | 256/1 X |
| 4,240,766 A | * | 12/1980 | Smith et al. | 256/13.1 X |
| 4,605,204 A | | 8/1986 | Schmanski et al. | |
| 4,787,603 A | | 11/1988 | Norton | |
| 4,806,046 A | * | 2/1989 | Clark | 404/10 |
| 5,066,163 A | | 11/1991 | Whitaker | |
| 5,180,143 A | | 1/1993 | Brower | |
| 5,186,119 A | | 2/1993 | Hlavin | |
| 5,252,076 A | | 10/1993 | Kelleher | |
| 5,299,781 A | | 4/1994 | Barrett et al. | |
| 5,402,988 A | | 4/1995 | Eisele | |
| 5,542,679 A | | 8/1996 | Caso | |
| 5,553,863 A | | 9/1996 | Wynne | |
| 6,343,778 B1 | | 2/2002 | Brown | |
| 2002/0070378 A1 | | 6/2002 | Brown | |

FOREIGN PATENT DOCUMENTS

DE 31 17 044 A1 11/1982

* cited by examiner

*Primary Examiner*—John Cottingham
(74) *Attorney, Agent, or Firm*—Husch & Eppenberger, LLC; H. Frederick Rusche

(57) ABSTRACT

A portable, fold-over fence panel for delineating athletic fields and controlling crowds includes a frame having a pair of vertical members and a pair of horizontal members; a panel of flexible material supported by the frame; first and second springs removably connected to the vertical members, each of the springs having a mounting spike integrally formed therewith for insertion into a soft, outdoor surface; first and second tubular feet interchangeable with said springs and suitable for supporting the frame on a hard surface; and wherein said springs allow the frame to fold over upon impact.

18 Claims, 8 Drawing Sheets

MULTI-PURPOSE PORTABLE LAY-DOWN FENCE

TECHNICAL FIELD OF THE INVENTION

This invention generally relates to fencing products and, more particularly, to a multi-purpose, portable fence incorporating a lay-down or fold-over feature.

DESCRIPTION OF THE RELATED ART

A number of outdoor and sport-related activities utilize fencing to enhance the playing environment for the activity in question. Baseball and softball are prime examples of such an activity. The construction of fencing to delineate the boundaries of the outfield and the playing field provides a more polished appearance to the field, provides the opportunity for players to hit "real" home runs, and helps limit the amount of playable foul territory surrounding the field. Fencing can also allow larger general purpose fields to be divided into several separate fields to accommodate a number of different games at one time, for example, during tournament play.

Permanent fencing, while durable and attractive, has a number of shortcomings. First of all, it can be prohibitively expensive. Also, permanent fencing does not allow for adjustments in field dimensions or field arrangements. In addition, because permanent fencing creates a solid vertical surface adjacent to the field, it presents a potential safety issue to athletes who may run into the fence while playing.

Temporary or portable fencing for athletic fields is also known in the art. Temporary fencing allows for an infinite number of adjustments in how an athletic or general purpose field can be arranged and divided for a number of different athletic events and other activities. For example, it is quite common for high schools, grade schools, or youth athletic associations to utilize a single field for football or soccer in the fall and baseball throughout the spring and summer. Temporary fencing allows these groups to arrange their limited field space in a more efficient and professional looking manner. In addition, these organizations frequently host different sporting events that involve different age groups. Temporary fencing allows an organization to customize a field's dimensions for a particular age group. For instance, a baseball outfield could be set up with smaller dimensions for grade school children than one for high school or college age athletes, allowing each of these different age groups to play on a baseball field properly suited to their size and playing ability while using the same general purpose field.

The most common form of such temporary fencing utilizes stakes to support a continuous plastic mesh material. The fences are not sturdy and tend to fall over quite easily when struck by a player or ball, requiring that the game be stopped while the fence is repositioned. Further, the stakes are generally inserted rigidly into the ground and may not give way when a player runs into them, creating a safety hazard. In addition, these fences are generally unattractive and are very labor intensive to install. Alternative designs incorporate individual fence panels made of polyvinyl chlorate ("PVC") or similar material with posts that are rigidly inserted into the ground or connected to wide feet resting perpendicular to the fence panel. Because these designs are rigidly mounted, they present the same safety concerns as permanent fencing. Furthermore, these designs have been priced out of reach of many schools, parks and recreation leagues in the past, which are the very groups that are most in need of the benefits of such fences.

Therefore, providing a fencing system capable of being installed quickly and manufactured and sold inexpensively, which does not present a significant safety hazard to athletes, would be highly desirable.

The present invention is directed to overcoming one or more of the problems set forth above.

SUMMARY OF THE INVENTION

An aspect of the present invention is to provide an affordable, portable fencing system for athletic fields, crowd control, and general purpose use that is quickly and easily installed.

Another aspect of the present invention is to provide a portable fencing system that is adapted for use on either outdoor turf or on indoor or hard surfaces.

Yet another aspect of the present invention is to provide a portable fencing system for athletic fields, crowd control, and general purpose use that is capable of folding over upon impact to minimize the chances for injury to a participant running into the fence and readily returning to an upright position after impact.

In accordance with the above aspect of the invention, there is provided a portable, fold-over fence panel for delineating athletic fields and general use that includes a frame having a pair of vertical members and a pair of horizontal members; a panel of flexible material supported by the frame; first and second springs removably connected to the vertical members, each of said springs having a mounting spike integrally formed therewith for insertion into a soft, outdoor surface; first and second tubular feet interchangeable with said springs and suitable for supporting the frame on a hard surface; and wherein said springs allow the frame to fold over upon impact.

These aspects are merely illustrative of the innumerable aspects associated with the present invention and should not be deemed as limiting in any manner. These and other aspects, features and advantages of the present invention will become apparent from the following detailed description when taken in conjunction with the referenced drawings.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION

Figure 1:
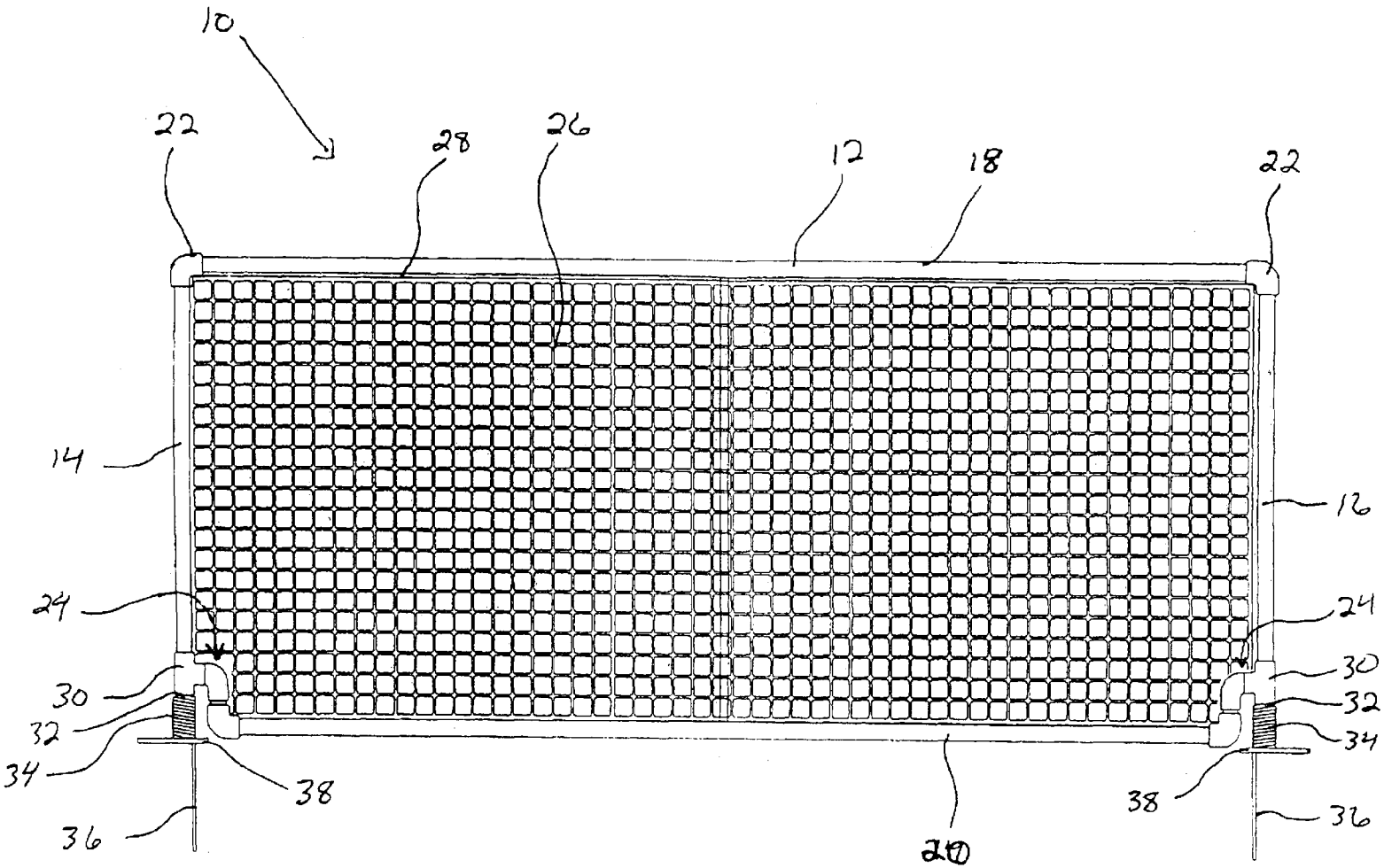
FIG. 1 is an elevation view of a portable, fold-over fence panel according to one embodiment of the present invention.
Figure 2A:
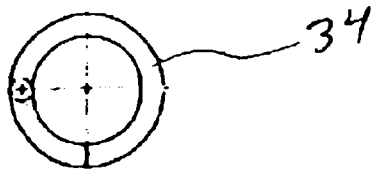
FIG. 2A is a top view of the spring/mounting spike of FIG. 2.
Figure 2:
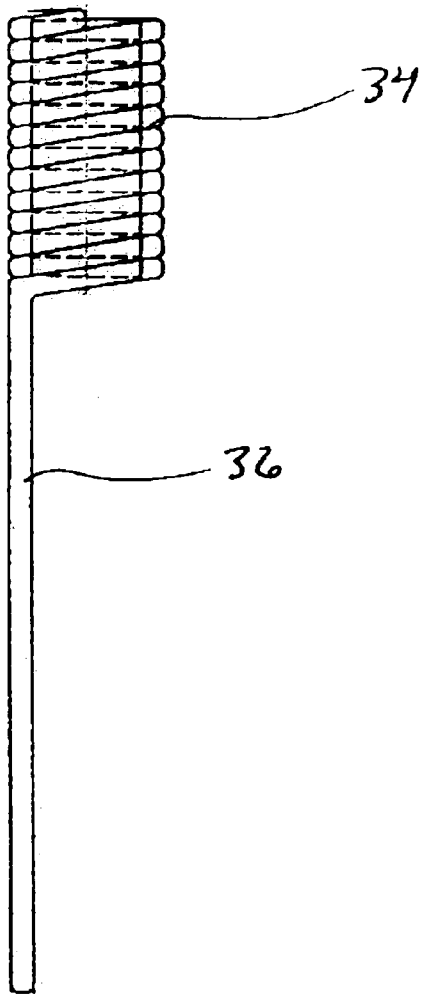
FIG. 2 is an elevation view of a combination spring/mounting spike utilized in the fence panel of FIG. 1.

In the following detailed description numerous specific details are set forth in order to provide a thorough understanding of the invention. However, it will be understood by those skilled in the art that the present invention may be practiced without these specific details. For example, the invention is not limited in scope to the particular type of industry application depicted in the figures. In other instances, well-known methods, procedures, and components have not been described in detail so as not to obscure the present invention.

FIGS. 1–6 illustrate a portable, multi-purpose, fold-over fence panel 10. The fence panel 10 is well-suited for use in a fencing system for delineating athletic fields, such as baseball and softball outfields, dividing a larger field into several separate athletic fields, and for general crowd control or other general purpose uses. The fence panel 10 is formed by a frame 12 that is composed of two vertical members 14, 16 and two horizontal members 18, 20. In a preferred embodiment, the vertical 14, 16 and horizontal 18, 20 members are connected by four rounded corner pieces 22. The rounded corner pieces 22 help minimize the presence of sharp corners or protrusions in the frame 12, thereby enhancing the overall safety of the fence panel 12. Advantageously, the frame 10, vertical members 14, 16, horizontal members 18, 20, and corner pieces 22 are all constructed of a tubular, lightweight, plastic material of any suitable cross-section, including round, square, rectangular, etc. In alternative embodiments, these items are constructed from wood, composite, or metal or aluminum piping. In a particularly preferred embodiment, the components of the frame 10 are composed of tubular PVC. The frame may also be constructed as a unitary structure without connecting corner pieces, e.g., a welded aluminum frame or a single aluminum pipe bent to the proper shape.

The lower horizontal member 18 of the frame 10 may be modified to include a pair of steps 24. The steps 24 aid in the installation of the fence panel by providing additional leverage for an installer in driving the mounting spikes (discussed in detail below) into the ground.

The frame 12 supports a panel of flexible material 26, which completes the fence panel 10. The panel 26 may be constructed from a number of suitable materials including a wire or plastic mesh, plastic or fabric netting, a solid panel of plastic material, or any other suitable lightweight, flexible material. In a preferred embodiment, the panel 26 is made of a flat laminar mesh made of high density polyethylene. The panel 26 is attached to the frame 12 by an attachment means 28. Suitable attachment means 28 include hook and loop fastening fabric, e.g., Velcro® strips, wire ties, or pipe. Lower profile attachment means without protrusions are preferred in order to enhance the safety of the fence panels.

The panel 26 can be personalized in a number of different ways. A particular color of material may be selected for the panel 26 to match a school's or an organization's unique color scheme. The panel 26 may also be adapted to hold a message banner, for example, advertisements of corporate event sponsors, thereby providing an additional source of revenue for an event organizer.

The two lower corner pieces 22 are advantageously T-shaped connectors 30. The lower end of these connectors provide the means for attaching a pair of springs 30 to the frame 12. An adapter 32 is inserted into the lower end of each T-shaped connector 30. A spring 34 is then slipped onto the adapter 32. The spring 34 is a coil spring preferably constructed of ⅜" diameter wire and is formed with an inside diameter slightly smaller than the outside diameter of the adapter 32 in order to create an interference fit between the spring 34 and the adapter 32. Each spring 34 terminates in a mounting spike 36.

In order to install the fence panel 10, the two mounting spikes 36 are inserted into the ground to provide a foundation for the fence panel 10. In a preferred embodiment, each mounting spike 36 is inserted through a plate 38 to provide additional stability to the fence panel 10. Each plate 38 is provided with a hole 40 having an inside diameter roughly equal or slightly larger than the wire gauge of the spring/mounting spike. The plate 38 rests at the top of the mounting spike 36 adjacent to the spring 34. Once installed, the plate 38 is sandwiched between the ground surface and the spring 34. The plate 38 is particularly beneficial when the fence panel 10 is installed on wet, muddy or loose turf. In a preferred embodiment, the plate 38 is also provided with a depression 41 that conforms to the angled bottom of the spring 34. This arrangement helps support the spring 34 in a more upright position, thereby further enhancing the stability and appearance of the fence panel 10.

The arrangement of the springs 34, mounting spikes 36 and stability plates 38 provide a particularly fast and efficient method of installing temporary fencing. Using this arrangement an entire baseball outfield fence utilizing approximately 150 feet or more of fence panels may be installed by two individuals in less than one hour. This arrangement also speeds removal of the fence panels.

Once the fence panel 10 is installed, the springs 34 act as a pivot point for the entire fence panel 10. If a player strikes the fence, for example, when chasing down a fly ball during a baseball or softball game, the springs 34 allow the fence panel 10 to fold flat during impact, thereby reducing the force of the impact on the player and limiting the potential for injury to the player. Advantageously, the coil spring design allows the springs 34 to respond to an impact occurring from almost any angle, including perpendicular to the fence panel or at a very shallow angle, i.e., when a player is running almost parallel to the fence prior to impact. The fence panel 10 will also fold over from an impact initiated from either side of the fence. This feature allows the fence to be used in configurations where play occurs simultaneously on both sides of the fence, for example, where a single fence separates the outfield of one baseball field from the outfield of another field, while producing the same safety advantages to players on both of the fields.

After impact and once the player has recovered and removed his/her weight from the fence panel 10, the panel readily returns to its upright position and is ready for further play without the need for repositioning or additional maintenance. This rebound feature is created by the use of a wire gauge in the design of the spring 34 that is capable of producing a spring force sufficient to counterbalance the weight of the frame 12. The rebound feature eliminates any delay to the game due to an impact between a player and the fence.

Figure 3:
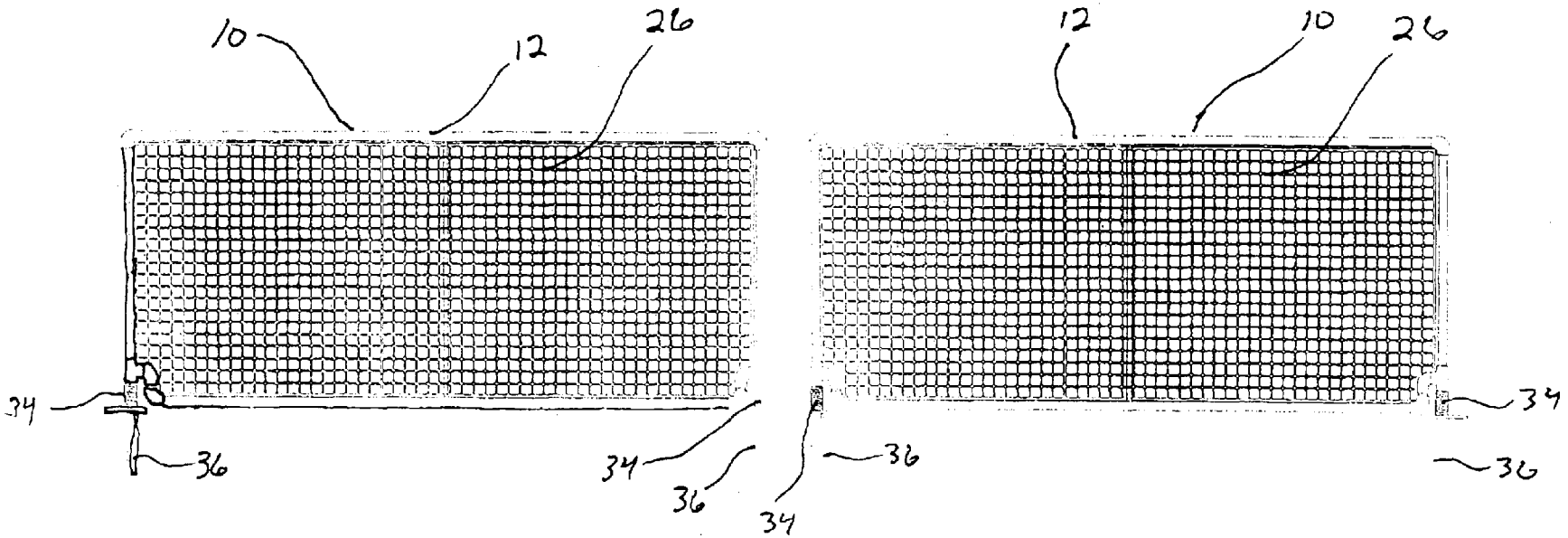
FIG. 3 is an elevation view of a portable, fold-over fence composed of separate panels according to another embodiment.
Figure 4:
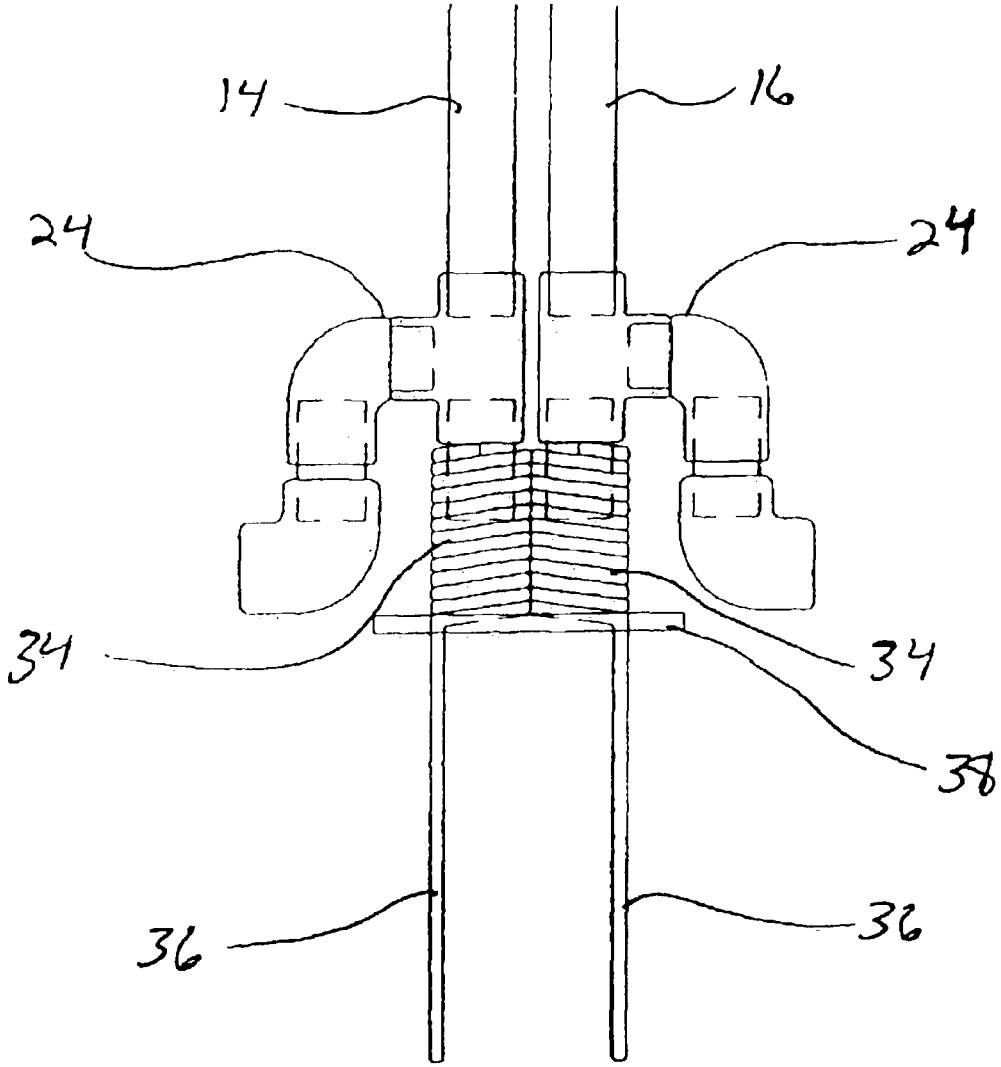
FIG. 4 is an elevation view of an interconnected spring/mounting spike assembly for a portable, fold-over fence composed of separate panels.
Figure 5:
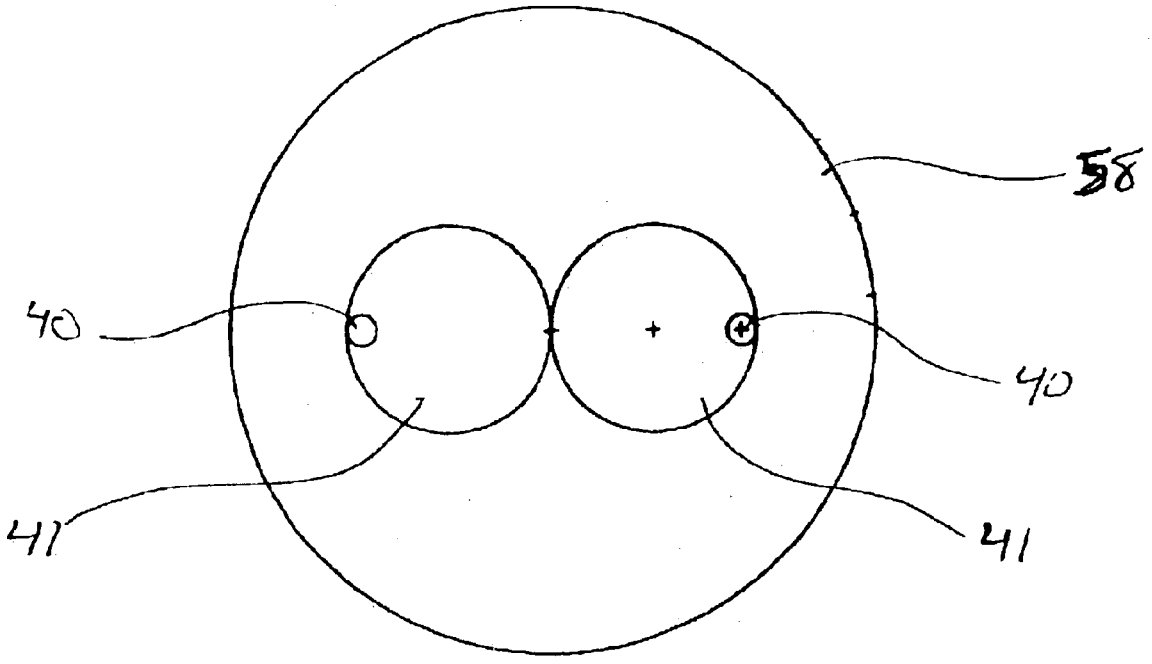
FIG. 5 is a plan view of a stability plate suitable for use with the embodiment of FIG. 4.
Figure 5A:
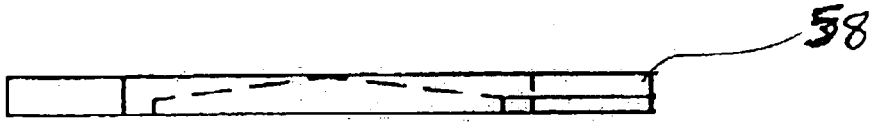
FIG. 5A is a side view of the stability plate of FIG. 5.
Figure 6:
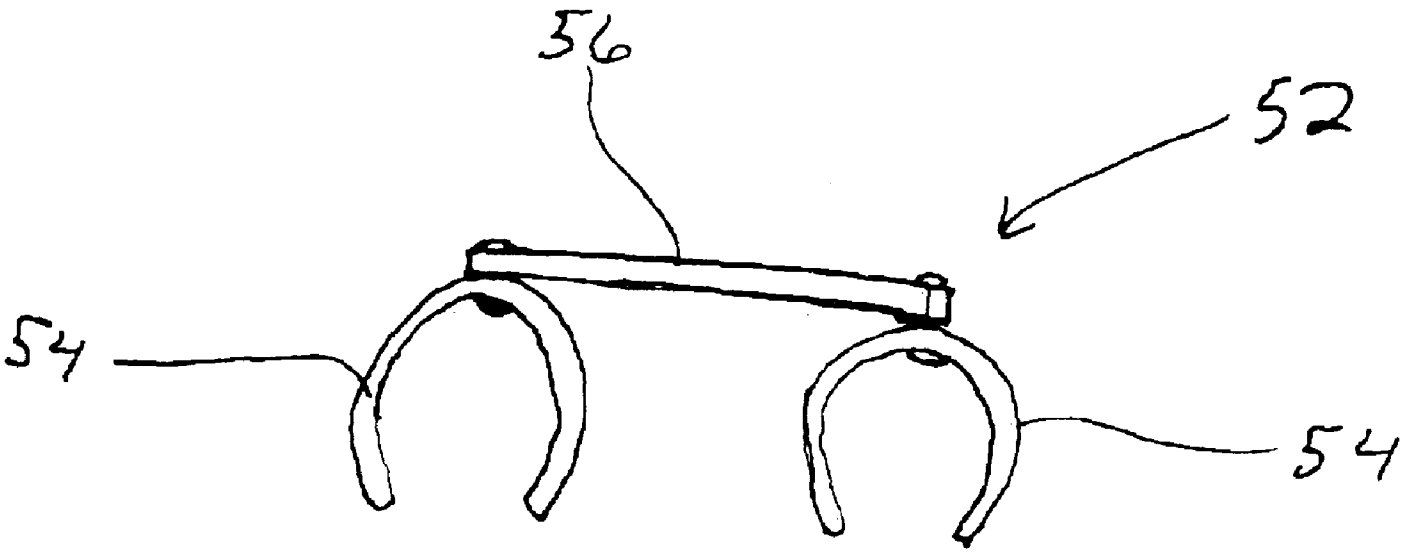
FIG. 6 is a plan view of a connecting clip suitable for interconnecting portable, fold-over fence panels according to another embodiment.

As shown in FIG. 3, a fence composed of fence panels 10 as described herein is constructed by installing a plurality of fence panels 10 immediately adjacent one another in a desired pattern, e.g., the outline of a baseball or softball outfield or to separate adjacent athletic fields. In installing the fence panels 10, it is not necessary that the fence panels be interconnected. The fence panels do not require interconnection for stability. Leaving the fence panels unconnected allows each individual fence panel to fold over and rebound on its own without affecting the neighboring panels. However, the panels may be interconnected if necessary with hook and loop fastening fabric, e.g., Velcro® strips, or other releasable means, thereby allowing individual panels to "break away" from adjacent panels upon impact. One alternate means of interconnecting adjacent fence panels, shown in FIG. 6, includes a connecting clip 52 formed by two open circular clips 54 preferable constructed of a lightweight plastic that are connected by a band 56. The open sides of the clips 54 allow the connecting clip 52 to "release" from one or both of the adjacent fence panels upon impact. An alternate means of interconnecting adjacent fence panels utilizes a dual stability plate 58. The plate 58 includes two holes 40 to accommodate mounting spikes 36 and two conforming depressions 41 to accommodate springs 34. In a particularly preferred version of this embodiment, the springs 34 for the adjacent fence panels 10 are connected together prior to installation on the adjacent fence panels and insertion into the stability plate 58.

Figure 7:
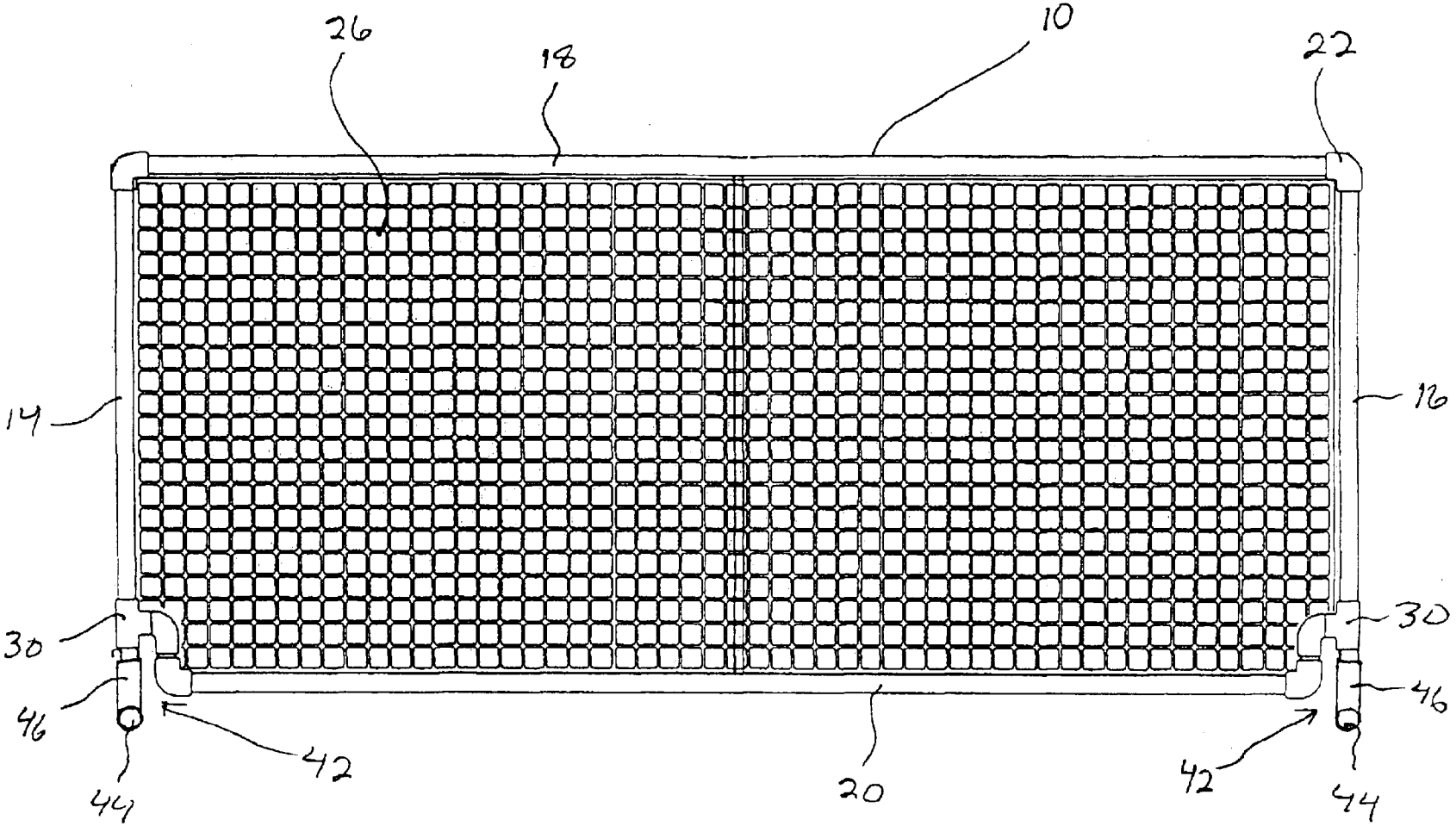
FIG. 7 is an elevation view of a multi-purpose, portable fence panel according to another embodiment.
Figure 7A:
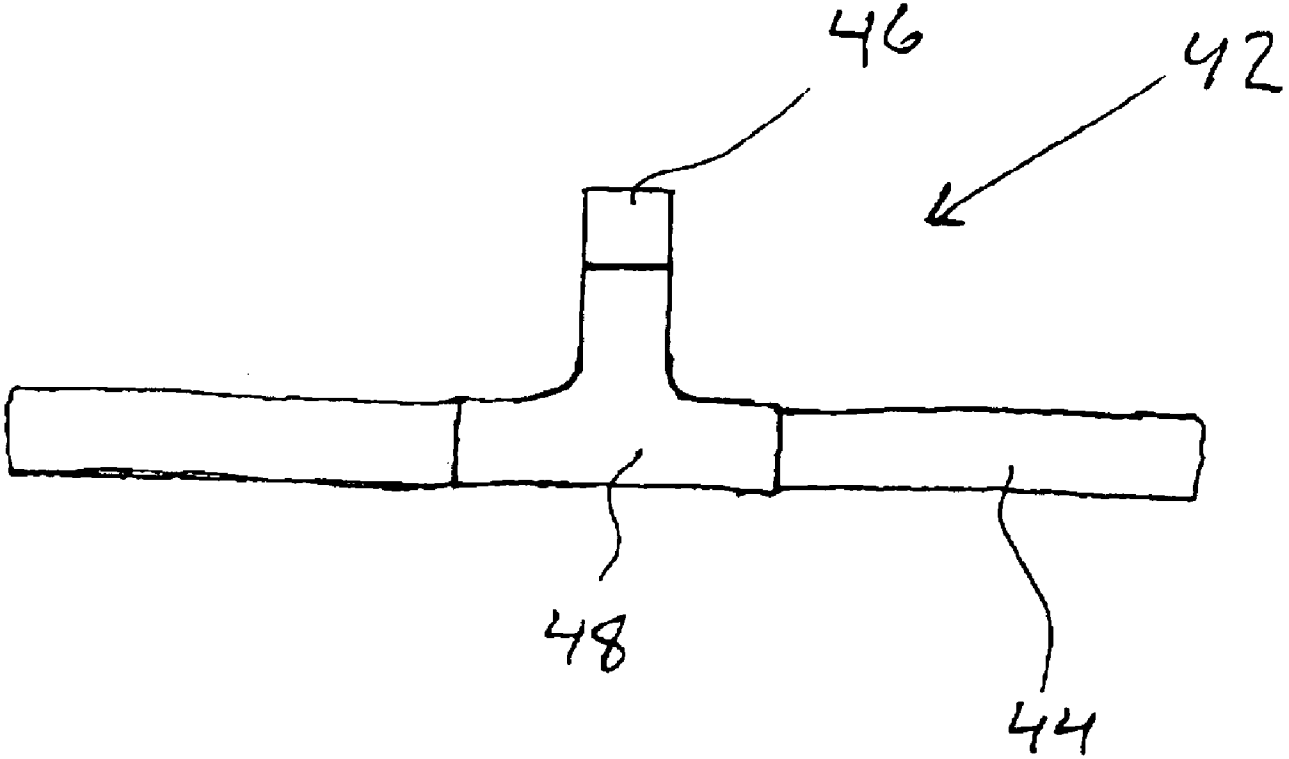
FIG. 7A is a side view of a foot assembly suitable for use with the embodiment of FIG. 7.

FIG. 7 illustrates the convertible nature of the above described fencing system. Each fence panel 10 may be quickly and easily adapted for use on any hard outdoor or indoor surface by replacing the adapters 32 and springs 34 with a pair of foot assemblies 42. Each foot assembly 42 includes a horizontal foot 44, a vertical leg 46, which is inserted into the lower end of T-shaped connector 30, and a T-connector 48, which connects the horizontal foot 44 and the vertical leg 46. In a preferred embodiment, the components of the foot assemblies 42 are constructed of tubular PVC. In an alternate embodiment, a spring 50 having a similar construction to spring 34, but without the mounting spike 36, is slipped onto the vertical leg 46 and the adapter 32. This embodiment allows the fence panel 10 to retain its fold-over and rebound features while using the foot assemblies 42. The ability to convert the fence panels 10 from outdoor to indoor use allows organizations to utilize the fencing system for a larger number of events, thereby enhancing the utility, value, and affordability of the fencing system.

Other objects, features and advantages of the present invention will be apparent to those skilled in the art. While preferred embodiments of the present invention have been illustrated and described, this has been by way of illustration and the invention should not be limited.

What is claimed is:

1. A portable, fold-over fence panel for delineating athletic fields and controlling crowds, including:

a frame having a pair of vertical members and a pair of horizontal members;

a panel of flexible material supported by the frame;

first and second springs removably connected to the vertical members, each of said springs having a mounting spike integrally formed therewith for insertion into a soft, outdoor surface, and said springs allowing the frame to fold over upon impact; and first and second tubular feet interchangeable with said springs and suitable for supporting the frame on a hard surface.

2. A portable, fold-over fence panel as set forth in claim 1, wherein the vertical and horizontal members are tubular.

3. A portable, fold-over fence panel as set forth in claim 2, wherein the tubular members are made of a plastic material.

4. A portable, fold-over fence panel as set forth in claim 3, wherein the plastic material is polyvinyl chlorate.

5. A portable, fold-over fence panel as set forth in claim 2, wherein the vertical and horizontal members are made of aluminum piping.

6. A portable, fold-over fence panel as set forth in claim 1, wherein the flexible fencing material is a flat laminar mesh made of high density polyethylene.

7. A portable, fold-over fence panel as set forth in claim 1, wherein the flexible fencing material is connected with the frame by hook and loop fastening fabric.

8. A portable, fold-over fence panel as set forth in claim 1, further including an adapter member connecting the first and second springs with the vertical members.

9. A portable, fold-over fence panel as set forth in claim 1, further including first and second stability plate associated with the mounting spikes wherein the stability plates are adjacent to the surface and the springs when the mounting spikes are inserted into the surface.

10. A portable, fold-over fence panel as set forth in claim 1, wherein one of the horizontal members is positioned below the other horizontal member and wherein the lower horizontal member includes at least one step.

11. A portable, fold-over fence panel as set forth in claim 1, wherein the vertical and horizontal members are connected by rounded corner brackets.

12. A portable, fold-over fence panel as set forth in claim 1, wherein the springs are coil springs and are constructed of ⅜" diameter wire.

13. A portable, fold-over fence panel as set forth in claim 1, further including first and second coil springs associated with the first and second tubular feet, respectively.

14. A portable, fold-over fence panel as set forth in claim 1, further including first and second adapters connecting the first and second springs, respectively, with the vertical members.

15. A convertible, portable fencing system for use on both outdoor and indoor surfaces, including:

a plurality of adjacent fence panels arranged in a desired pattern, each fence panel having:

a frame having a pair of vertical members and a pair of horizontal members;

a panel of flexible material supported by the frame;

first and second springs removably connected to the vertical members, each of said springs having a mounting spike integrally formed therewith for insertion into a soft, outdoor surface; and first and second tubular feet interchangeable with said springs and suitable for supporting the frame on a hard surface.

16. A convertible, portable fencing system as set forth in claim 15, wherein the adjacent fence panels are interconnected with releasable connection means.

17. A convertible, portable fencing system as set forth in claim 16, wherein the releasable connection means is a hook and loop fastening fabric associated with the frames of the adjacent fence panels.

18. A method of converting a fence panel from outdoor to indoor use, including the steps of:

providing a fence panel having a frame with a pair of vertical members and a pair of horizontal members, a panel of flexible material supported by the frame, and first and second springs removably connected to the vertical members, each of said springs having a mounting spike integrally formed therewith for insertion into a soft, outdoor surface;

providing first and second tubular feet interchangeable with said springs and suitable for supporting the frame on a hard surface;

removing the springs from the vertical members; and connecting the tubular feet with the vertical members.

* * * * *